US005539942A

United States Patent [19]

Melou

[11] Patent Number: 5,539,942

[45] Date of Patent: Jul. 30, 1996

[54] CONTINUOUS AIRFLOW PATIENT SUPPORT WITH AUTOMATIC PRESSURE ADJUSTMENT

[76] Inventor: Yves Melou, 188, Rue Du Caducee, Parc Euromedecine, 34033 Montpellier Cedex 1, France

[21] Appl. No.: 169,499

[22] Filed: Dec. 17, 1993

[51] Int. Cl.[6] ..... A47C 27/08

[52] U.S. Cl. ..... 5/453; 5/455; 5/914

[58] Field of Search ..... 5/453, 455, 456, 5/914

[56] References Cited

U.S. PATENT DOCUMENTS

| | | | |
|---|---|---|---|
| 945,234 | 1/1910 | Hinsdale . | |
| 4,099,276 | 7/1978 | Hunt et al. . | |
| 4,193,149 | 3/1980 | Welch . | |
| 4,279,044 | 7/1981 | Douglas . | |
| 4,391,009 | 7/1983 | Schild et al. . | |
| 4,488,322 | 12/1984 | Hunt et al. . | |
| 4,542,547 | 9/1985 | Sato | 5/456 |
| 4,694,520 | 9/1987 | Paul et al. . | |
| 4,768,249 | 9/1988 | Goodwin . | |
| 4,797,962 | 1/1989 | Goode . | |
| 4,833,457 | 5/1989 | Graebe, Jr. | 5/455 |
| 4,873,737 | 10/1989 | Savenije | 5/455 |
| 4,896,389 | 1/1990 | Chamberland . | |
| 4,949,414 | 8/1990 | Thomas et al. . | |
| 5,189,742 | 3/1993 | Schild | 5/455 |

FOREIGN PATENT DOCUMENTS

| | | | |
|---|---|---|---|
| 0114762 | 6/1984 | European Pat. Off. . | |
| 0341570 | 11/1989 | European Pat. Off. . | |
| 08438 | 9/1989 | WIPO | 5/453 |

*Primary Examiner*—Michael J. Milano
*Attorney, Agent, or Firm*—Dority & Manning

[57] ABSTRACT

A patient support device includes a patient support surface formed of chambers continuously inflated with air from a blower. A sensor in the form of either a tubular member or pressure sensitive switch is configured to be disposed at the base of at least one of the individual inflatable chambers of the patient support device and can be configured to be disposed in the interstice between two adjacent chambers in a manner so that normal support of the patient's body on the chamber(s) does not put the patient's body in contact with such sensor or deform the adjacent chamber(s) sufficiently to cause such chamber(s) to apply pressure to such sensor. The flow of air exhausted from the chambers can be varied by a variable flow valve or by a flexible gasket that variably engages an outlet tube. The flow permitted through the valve or by the gasket can be controlled by a controller based on signals from the sensor. The controller also can control the speed of the blower based on signals from the sensor.

17 Claims, 5 Drawing Sheets

CONTINUOUS AIRFLOW PATIENT SUPPORT WITH AUTOMATIC PRESSURE ADJUSTMENT

BACKGROUND OF THE INVENTION

The present invention relates to continuous air flow overlays or mattresses that are disposed between a patient and a rigid support and more particularly to those that regulate the pressure.

U.S. Pat. No. 4,896,389 to Chamberland, which is assigned to a company related to the assignee of this application, discloses an inflatable air mattress in the form of an overlay that is used to improve the comfort of patients that are immobilized over long periods of time, and is hereby incorporated herein by this reference. A compressor supplies this mattress overlay with a continuous flow of air. The pressure supplied by the compressor is adjusted manually to suit the comfort of the individual patient. As the patient changes his or her body position on the overlay, an additional manual adjustment of the compressor pressure can be made to suit the comfort of the patient in the new position.

In U.S. Pat. No. 4,488,322 to Hunt et al, a mattress body incorporates a plurality of header chambers 19 which are connected to air supply conduits 11, 13. Air is supplied from a blower which contains pressure control valves for each supply conduit. One end of each of a plurality of inflatable sacs 10 is connected to a connector 21 in a header chamber 19 so that air can be supplied to the air sac 10 via the conduits 11, 13 and header chamber 19. The other end of each of the plurality of inflatable sacs 10 is connected to a connector 22 in an exhaust header chamber 20, which is connected to an exhaust conduit 23. A flow control valve 31 is linked between the corresponding exhaust conduit 23 and supply conduit 11 to eliminate small differences in air flow through each group of air sacs.

OBJECTS AND SUMMARY OF THE INVENTION

It is a principal object of the present invention to provide an inflated patient support surface in the form of an overlay or mattress with an automatic pressure regulation system that automatically adjusts the inflation pressure of the overlay or mattress to maintain a desirable degree of penetration of the patient into the support surface of the overlay or mattress and regardless of the positioning situation (back rest elevation, side lying, etc.) of the supported patient.

It is another principal object of the present invention to provide an inflated patient support surface in the form of an overlay or mattress with an automatic pressure regulation system that detects the pressure in each individual section of the overlay or mattress and automatically adjusts the inflation pressure of the overlay or mattress to maintain a desirable degree of penetration of the patient into the support surface of the overlay or mattress and regardless of the positioning situation (back rest elevation, side lying, etc.) of the supported patient.

It is a further principal object of the present invention to provide an inflated patient support surface in the form of an overlay or mattress with an automatic pressure regulation system that detects the pressure in at least one individual section of the overlay or mattress and automatically adjusts the inflation pressure of that section of the overlay or mattress to prevent the patient from penetrating too deeply into that section of the support surface of the overlay or mattress, regardless of the positioning situation (back rest elevation, side lying, etc.) of the supported patient.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an apparatus for automatically regulating the support pressure in at least one inflatable chamber forming at least a part of the support surface of a continuous airflow patient support device, can be provided. Desirably, the automatic pressure regulating apparatus can include a means for sensing when the patient is being supported with a degree of penetration of the patient into the support surface of the patient support device that exceeds a predetermined desirable degree of penetration. Such excessive degree of penetration places the patient in a position unduly close to the rigid base of the patient support device and increases the chance that a portion of the patient's body will contact such base. The penetration sensing means can include a sensor in the form of at least one flexible tubular member. Each tubular member is configured to be disposed at the base of at least one of the individual inflatable chambers of the patient support device and can be configured to be disposed in the interstice between two adjacent chambers in a manner so that normal support of the patient's body on the chamber(s) does not put the patient's body in contact with such tubular member or deform the adjacent chamber(s) sufficiently to cause such chamber(s) to apply pressure to such tubular member. So configured and disposed, a change in pressure on the inflatable chamber sufficient to cause the patient's body to sink close enough to the uninflated base of the patient support device to apply pressure to the tubular member or cause the inflatable chamber to do so, subjects the at least one tubular member to a change in pressure. The change in pressure signals the excessive penetration. The at least one tubular member can be combined with a plurality of similarly configured tubular members in a configuration that forms an interconnected tubular grid. An alternative embodiment of the penetration sensing means can include one or more sensors in the form of one or more pressure switches disposed in a manner comparable to the disposition of the tubular members.

In a multi-zone embodiment, the penetration sensing means can include an individual pressure sensor for each of the groups of chambers of the patient support device. For example, a separate tubular grid can be provided for each discrete group of inflatable chambers that is supplied with air by its own air supply conduit of the patient support device.

The present invention can include a means for exhausting air from the air supply conduit. In an embodiment having a plurality of penetration sensing means, a separate means for exhausting air from the air supply conduit of the patient support device can be provided for each penetration sensing means. The air exhausting means can include a plenum having an inlet opening and an outlet opening. The plenum's inlet opening can be connected in communication with the air supply conduit for the chambers of the patient support device. The air exhausting means also can include an outlet tube disposed through the outlet opening in the plenum and having an open exhaust end and an open entrance end. A muffler can be disposed around the open exhaust end of the outlet tube.

The present invention can include a means for varying the flow of air exhausted from the air exhausting means. In an embodiment configured for a patient support device with more than one separately inflated group of chambers, the exhaust flow varying means can include a separate exhaust flow varying means for each separate air exhausting means. Each exhaust flow varying means can include a variable flow valve having an inlet connected in communication with the inlet opening of the air exhausting means. The variable flow valve can have an outlet connected in communication with the outlet opening of the plenum and with the outlet opening of the air exhausting means.

In an alternative embodiment, the exhaust flow varying means can include a flexible sealing gasket which can be configured and disposed to variably engage the entrance end of the outlet tube. In this alternative embodiment, a rigid member can be pivotally mounted at one end of the rigid member and have an intermediate portion that carries the sealing gasket to variably engage the entrance end of the outlet tube. As the rigid member pivots about its one end, the flexible gasket carried by the intermediate portion of the rigid member variably engages the entrance end of the outlet tube and thus regulates the amount of air flowing through the entrance end of the outlet tube and into the muffler. As the gasket increasingly engages the entrance of the outlet tube, the rate of air flow that is permitted to escape through the outlet tube decreases. Similarly, as the gasket decreasingly engages the entrance of the outlet tube, an increased rate of air flow is permitted to flow through the outlet tube.

The present invention can include a means for controlling the exhaust flow varying means in accordance with a signal received from the penetration sensing means when the penetration sensing means senses what would be considered more than an ideal degree of penetration of the patient into the patient support surface. In an embodiment configured for a patient support device with at least two separately inflated groups of chambers, the controlling means can include a separate controlling means for each separate exhaust flow varying means. One embodiment of the controlling means can include a controller that desirably can be connected into communication with the penetration sensing means and the exhaust flow varying means. For example, the controller can be electrically connected to a motor which opens and closes the variable flow valve depending on the electrical signal generated by the controller.

One embodiment of the controlling means that is suitable when the penetration sensing means includes a tubular member, can include a pressure transducer in addition to the controller. An air communication conduit can connect the tubular member of the penetration sensing means into fluid communication with the pressure transducer, which is connected in electrical communication with the controller.

Another alternative embodiment of the controlling means that is suitable when the penetration sensing means includes a tubular member, can include a bellows disposed inside the plenum. The interior of the bellows can be connected in fluid communication with the tubular member of the penetration sensing means via an air communication conduit. In this alternative embodiment, the rigid member has a biasing portion that is disposed against the exterior of the bellows. This alternative embodiment of the controlling means can include a means for biasing the biasing portion of the rigid member against the bellows. The biasing means can include a detent biased by a spring against the biasing portion of the rigid member. A threaded screw can be used to adjust how the spring is deployed against the detent.

One alternative embodiment of the present invention that is suitable when the penetration sensing means includes a tubular member, can include a means for supplying air to the tubular member of the penetration sensing means via the air supply conduit of the device without returning air from the penetration sensing means to the air supply conduit of the device. In an embodiment having a plurality of separate groups of chambers in the patient support device, a separate air supplying means can be provided for each separate penetration sensing means. The air supplying means can include a pressure regulator and a check valve connected in communication with the air communication conduit. Alternatively, the air supplying means can include a push-button valve connected in communication with the air communication conduit. In embodiments using a push-button valve instead of a pressure regulator and a check valve, in order to prevent inadvertent pressing of the button and depletion of the chambers of the overlay when the patient is being supported on the chambers of the overlay, a conventional means for preventing the button of the push button valve from being pushed, can be provided.

The accompanying drawings, which are incorporated in and constitute a part of this specification, illustrate at least one embodiment of the invention and, together with the description, serve to explain the principles of the invention. The same numbers are used to indicate the same features throughout the drawings.

DETAILED DESCRIPTION OF THE PREFERRED EMBODIMENTS

Reference now will be made in detail to the presently preferred embodiments of the invention, examples of which being illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

Figure 1:
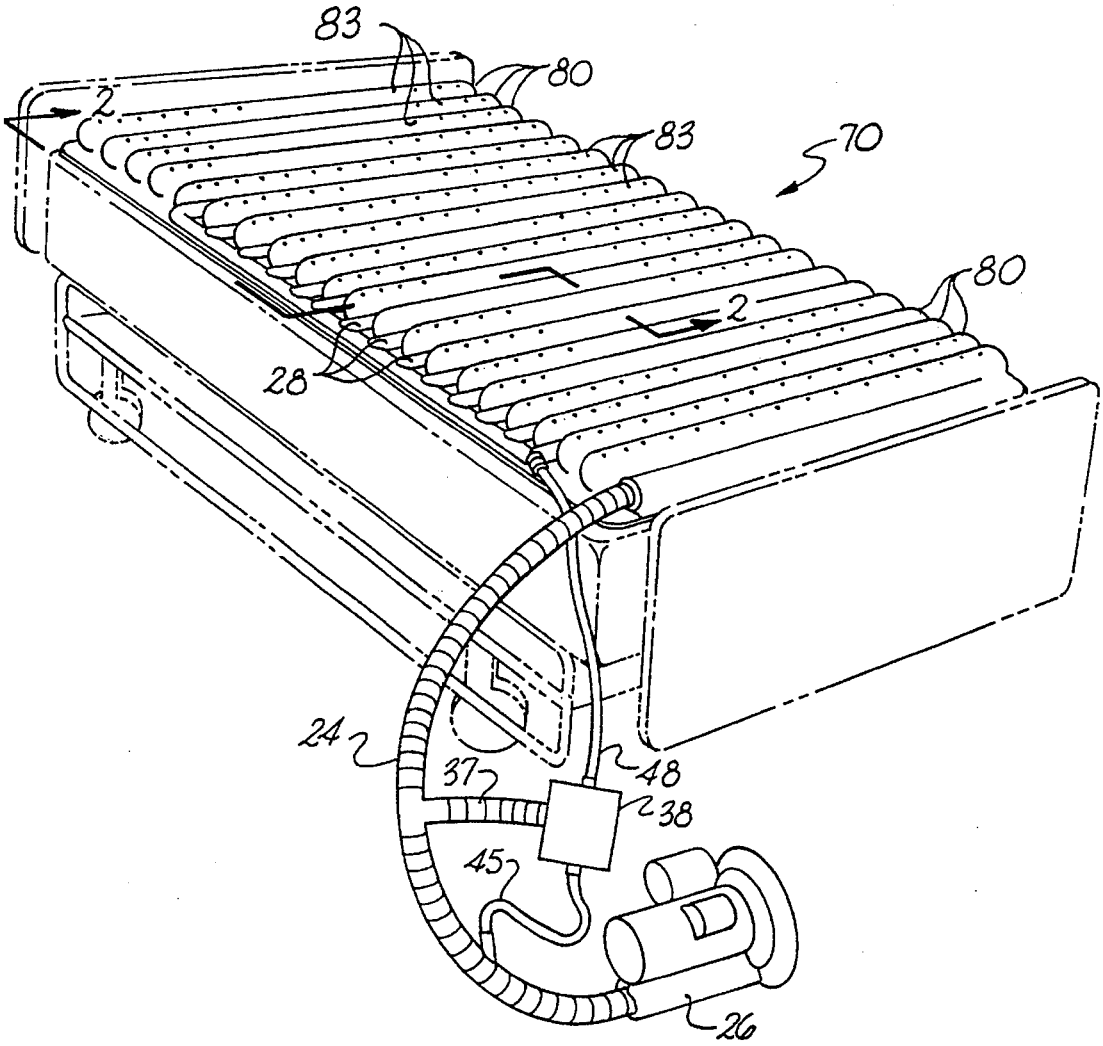
FIG. 1 schematically depicts an elevated perspective view of a preferred embodiment of the present invention.
Figure 2:
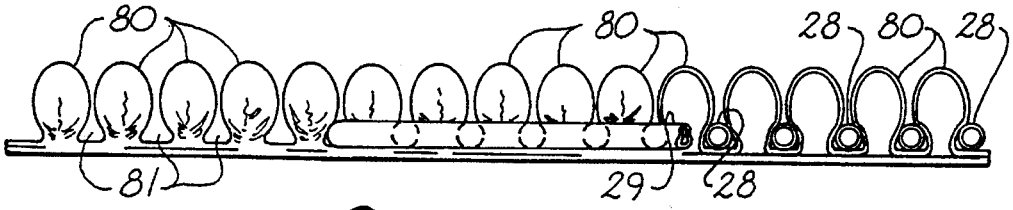
FIG. 2 shows an end plan view in part and a cross-sectional view in part taken along the line of sight in the direction of arrows 2, 2 of FIG. 1.

A preferred embodiment of a patient support device with automatic pressure adjustment is shown in FIG. 1 in the form of a continuous airflow overlay and is represented generally by the numeral 70 with the headboard, footboard, siderails and undercarriage of an ordinary bed being shown in dashed lines. The patient support device also could be provided in the form of a continuous airflow mattress, but an overlay is used for purposes of illustration in the drawings. An alternative preferred embodiment might include 5 separately inflatable zones. To illustrate the principles of a multi-zone embodiment without unduly complicating the drawings, a 3-zone embodiment is schematically shown in FIG. 7 and is represented generally by the numeral 71.

In accordance with the present invention, a patient support device can include a plurality of individual inflatable chambers 80 that form the support surface of the patient support device. As schematically shown in FIGS. 1, 7 and 8 for example, each individual inflatable chamber 80 is provided with inflating air via an air supply conduit 24, which receives air from a blower 26 or other air supply device. As shown in U.S. Pat. No. 4,896,389 to Chamberland, such patient support devices in the form of an overlay can continuously flow air through the chambers of the device via an air distribution channel (not separately depicted in detail here). As shown in FIG. 1, the patient support device desirably can be formed in a configuration that results in a low air loss device by providing a plurality of small bleed holes 83 through one or more of the individual chambers 80. As shown schematically in FIGS. 3, 7 and 8, the patient support device desirably should be formed so that an interstice 81 is formed between the bases of the exterior surfaces of adjacent chambers 80. This same configuration can be provided for the inflatable air sacks of a FLEXICAIR® bed or a RESTCUE® bed, examples of which are respectively disclosed in U.S. Pat. Nos. 4,768,249 and 4,949,414, which patents are hereby incorporated into this application by this reference.

Figure 7:
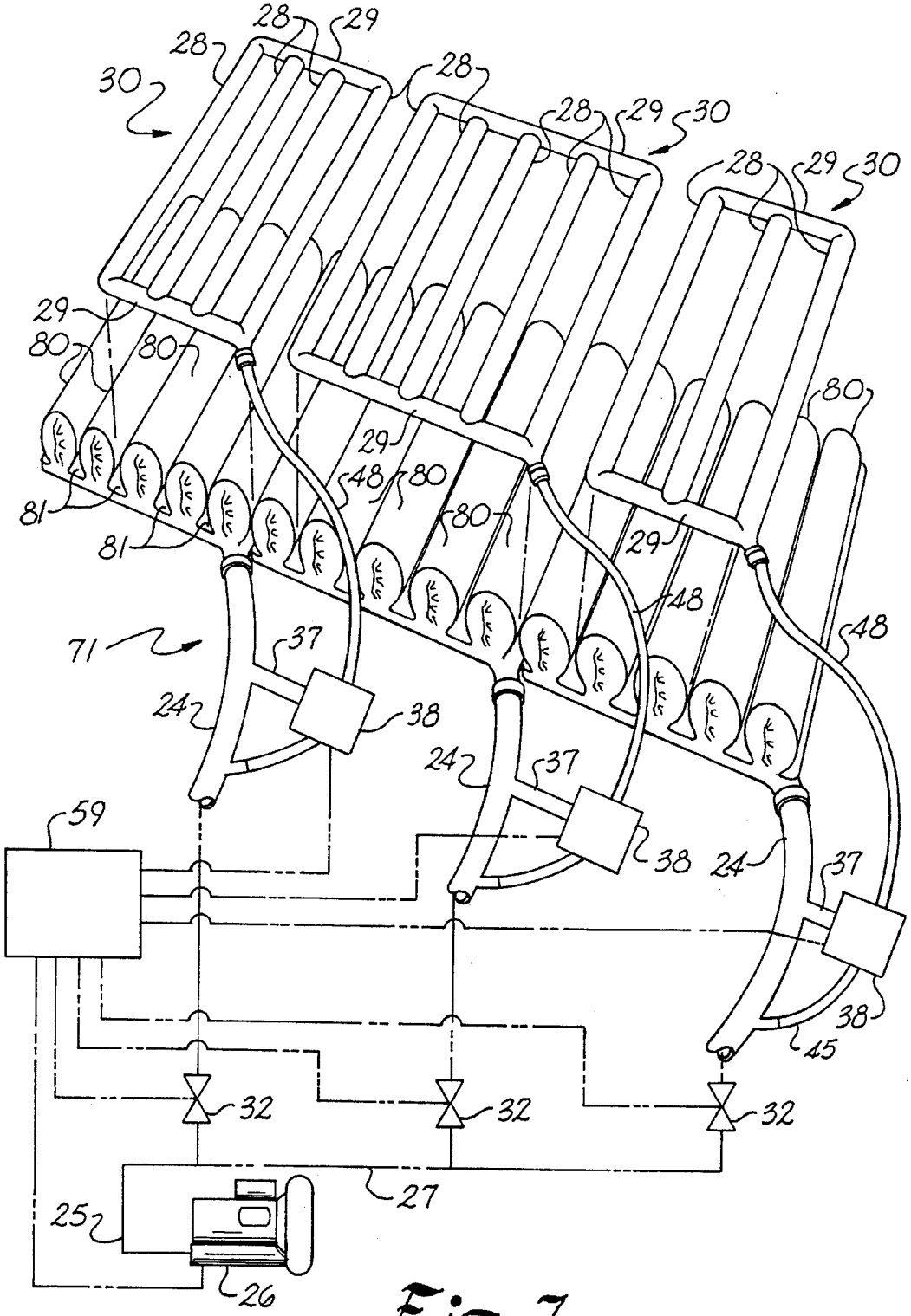
FIG. 7 schematically depicts an elevated perspective view of alternative preferred embodiments of components of the present invention.
Figure 8:
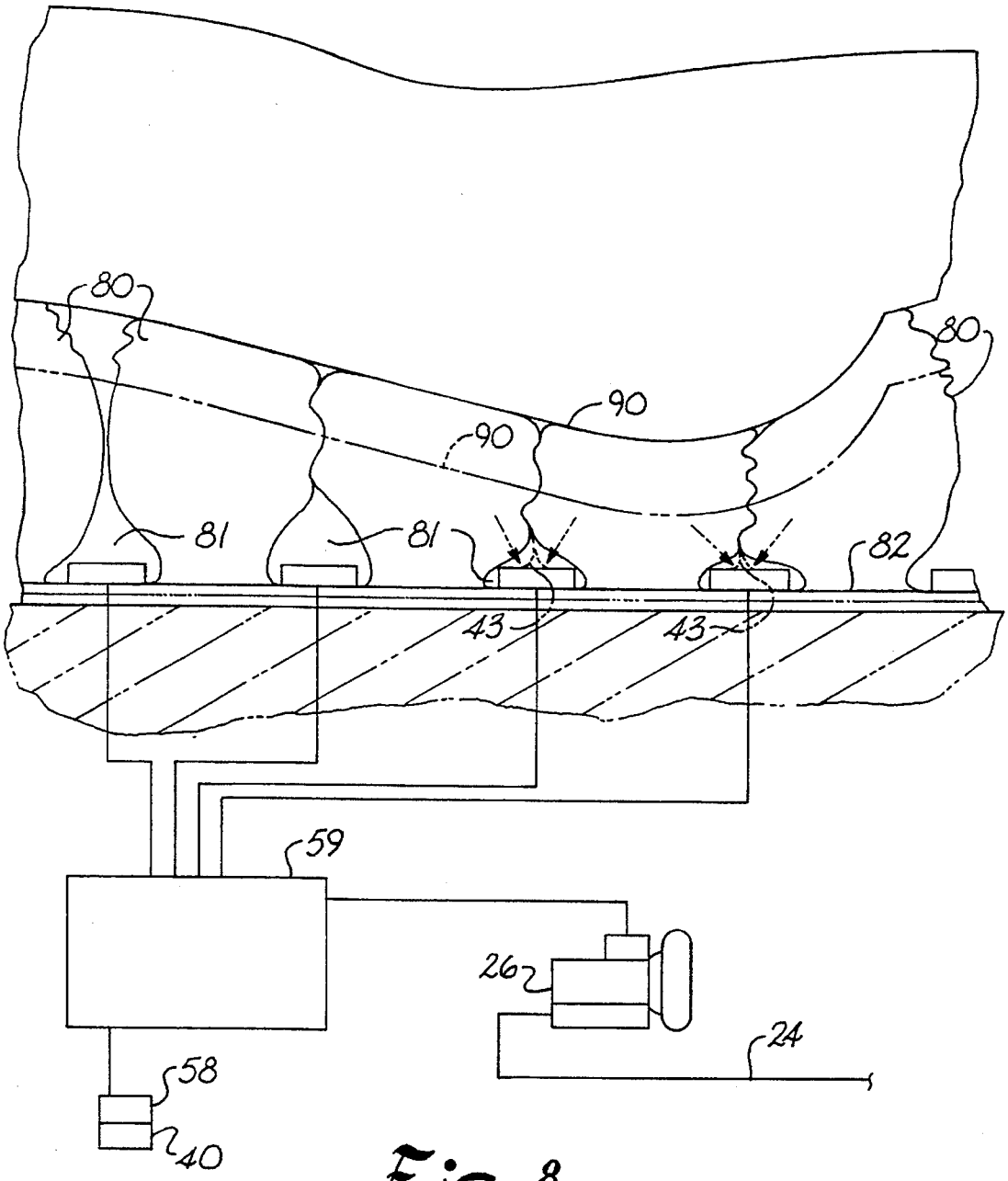
FIG. 8 schematically depicts a partial end plan view of a preferred embodiment of the present invention with portions of the components cut away and one outline of a patient's body and portions of the components shown in phantom by dashed lines.

In a multi-zone embodiment of the patient support device such as shown in FIG. 7, the main air supply hose 25 coming from the blower 26 can feed into an air supply manifold 27, which can supply air separately to each of at least two separate air supply conduits 24. Each air supply conduit 24 can supply air to each of at least two separate groups of chambers 80 of the patient support device. A separate flow control valve 32 can regulate the flow of air from the manifold 27 to each respective air supply conduit 24. Each flow control valve 32 can be electrically operable and as schematically shown in FIG. 7 by dashed lines, each valve 32 can be controlled by a common controller 59 which is electrically connected to each flow control valve 32.

In accordance with the present invention, an apparatus for automatically regulating the support pressure in at least one inflatable chamber forming at least a part of the support surface of a patient support device can be provided. Desirably, such apparatus can automatically regulate the support pressure in at least one, if not each, of a plurality of individual inflatable chambers forming the support surface of the patient support device.

Optimal penetration of the patient's body into the chambers (such as 80 in FIG. 1) of the patient support device is achieved when the largest surface area of the chambers is supporting the patient's body. This condition typically occurs when the patient is as close to the base of the chambers without actually bottoming on the rigid base of the overlay or mattress. However, for the added comfort and safety of the patient, the ideal penetration is something less than optimal as described above. The ideal penetration leaves an additional margin of distance between the patient's body and the base of the patient support device. This additional margin of distance allows for sudden movements of the patient that might otherwise cause a portion of the patient's body to contact the rigid base of the patient support device. Thus, the pressure regulating apparatus should be able to sense when this ideal penetration condition has been attained and should regulate the pressure in the chambers so that the patient does not exceed this ideal penetration and risk bottoming against the base of the patient support device.

In accordance with the present invention, the automatic pressure regulating apparatus can include a means for sensing when a portion of the patient is exceeding a predetermined desirable degree of penetration into the support surface of the patient support device. The penetration sensing means desirably is disposed near the base of at least one inflatable chamber of the patient support device. In one embodiment shown in FIGS. 1–4 and 7, the penetration sensing means can include a sensor in the form of at least one flexible tubular member 28. The material and construction method used to form each tubular member 28 must result in a tubular member that is airtight and that is flexible enough to respond to pressure changes on its outer surface. Sheets of flexible rubber latex material that are cemented together are desirable for this purpose, as are thin sheets of neoprene. Each tubular member 28 desirably can be formed of the same materials and by the same technology used for forming the chambers 80 of the overlay itself, provided that such materials and method result in an airtight structure. Alternatively, as shown in FIG. 8 for example, the sensing means can include a pressure sensitive switch 43 that emits an electrical signal when subjected to a pressure above a threshold pressure.

Figure 3:
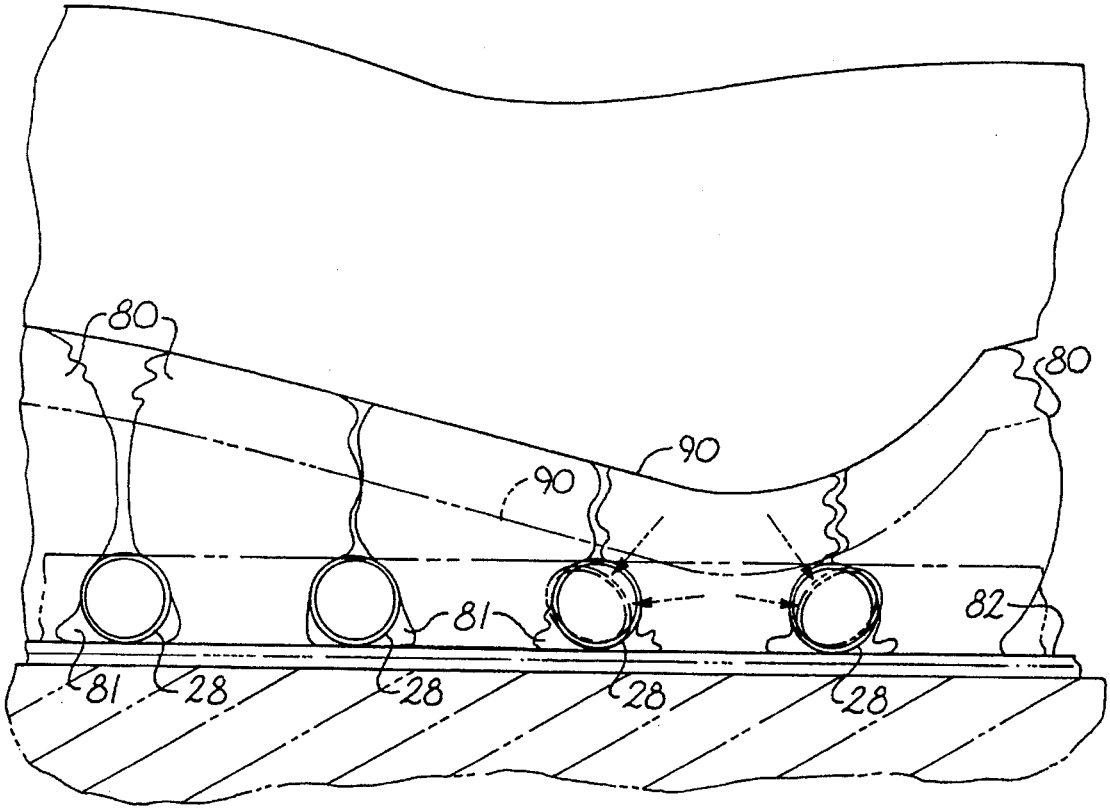
FIG. 3 schematically depicts a partial end plan view of components shown in FIG. 1 with the outline of a patient's body and portions of the components cut away and portions shown in phantom by dashed lines.

As schematically shown in FIGS. 1–4 or 8, each such tubular member 28 or pressure sensitive switch 43, respectively, is configured to be disposed at the base of one of the individual inflatable chambers 80 of the patient support device. As schematically shown in FIG. 3 or 8, each respective tubular member 28 or switch 43 is configured to be disposed in the interstice 81 between two adjacent chambers 80. Moreover, it is desirable that each such tubular member 28 (or pressure sensitive switch 43) is configured with respect to the adjacent chambers 80 and their interstices 81 so that normal support of the patient's body on the support surface formed by chambers 80 does not cause the patient's body to contact tubular member 28 (or pressure sensitive switch 43) or deform the adjacent chamber(s) 80 sufficiently to cause such chamber(s) 80 to apply greater than a threshold pressure to such tubular member 28 or switch 43. Examples of a so-called normal support position of the patient's body 90 are schematically shown in FIGS. 3 and 8 with the outline of the patient's body 90 in solid line. Moreover, with the chamber(s) 80 and tubular member(s) 28 so desirably configured and disposed, pressure will not be applied to the member 28 or switch 43 unless the patient's body sinks almost to touch the uninflated base 82 of the patient support device. Once the patient's body sinks close enough to the uninflated base 82 of the patient support device, a portion of the patient's body will either contact tubular member 28 (or pressure sensitive switch 43) or cause one or more of the chamber(s) 80 to do so (as schematically shown by the dashed arrows in FIGS. 3 and 8) with the requisite threshold pressure.

In the case of switch 43, the application of greater than a threshold pressure to switch 43, activates switch 43. Activation of switch 43 transmits an electrical signal. In this way, the at least one pressure sensitive switch 43 functions as a means for sensing when the patient has penetrated too closely to the base of the patient support device and penetrated beyond the ideal depth into chambers 80.

Similarly, in the case of member 28, the deformation of at least one tubular member 28 (shown in dashed line in FIG. 3), causes a commensurate change in the pressure in at least one tubular member 28. The change in pressure acts as a signal. In this way, the at least one tubular member 28 functions as a means for sensing when the patient has penetrated too closely to the base of the patient support device and penetrated beyond the ideal depth into chambers 80. While the spatial relationships between the patient's body outline 90, chambers 80, tubular members 28 or switches 43, and the uninflated base 82 of the patient support device schematically shown in FIGS. 3 and 8, are not drawn to scale, they are intended to facilitate explanation of the operation of the present invention. FIGS. 3 and 8 provide examples of the shapes of chambers 80 when the body 90 (schematically shown in dashed line in FIGS. 3 and 8) is being supported undesirably close to the uninflated base 82 of the patient support device. FIG. 3 also provides examples of the shapes of members 28 and dashed arrows pointing toward members 28 or switches 43 to indicate the conditions when the body 90 (schematically shown in dashed line in FIGS. 3 and 8) is being supported undesirably close to the uninflated base 82 of the patient support device. Similarly, FIGS. 3 and 8 provide examples of the shapes of chambers 80 during acceptable penetration of the patient's body 90 (schematically shown in solid line in FIGS. 3 and 8) into the chambers 80 without approaching the base 82 of the patient support device too closely. During this acceptable penetration condition, FIG. 3 depicts the shapes of members 28 in solid line and without any arrows pointing toward them.

Figure 4:
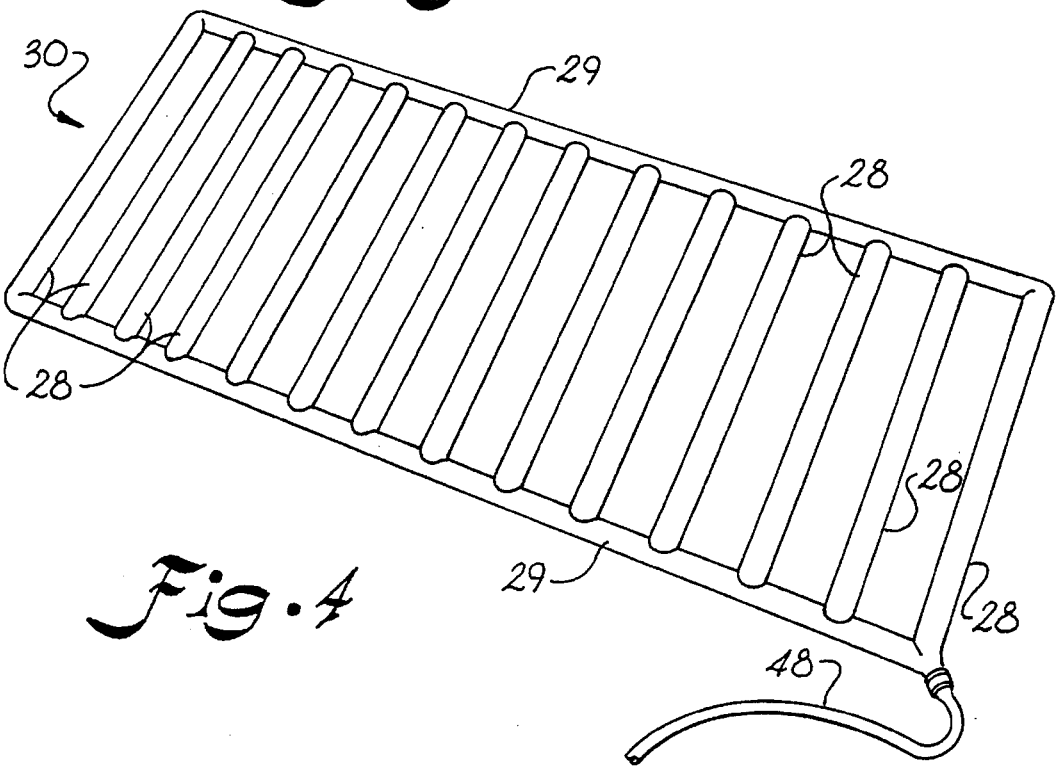
FIG. 4 schematically depicts an elevated perspective view of a preferred embodiment of a component of the present invention.

As shown in FIGS. 4 and 7, the at least one tubular member 28 can be combined with a plurality of tubular members 28, 29 in a configuration that forms an interconnected tubular grid 30. As with the tubular members 28 themselves, the material and construction method used to form each tubular grid 30 must result in a tubular grid 30 that is airtight and that has tubular members 28 flexible enough to respond to pressure changes on their outer surfaces. Provided these criteria are met, each tubular grid 30 desirably can be formed of the same materials and by the same technology used for the inflatable portions of the patient support device itself. Each tubular grid 30 can be configured and disposed with a tubular member 28 at the base of at least one of the individual inflatable chambers 80 of the patient support device. Desirably, in the case of at least some of the tubular members 28, each tubular member 28 is disposed at the base of at least two of the adjacently disposed individual inflatable chambers 80 of the patient support device. Preferably, the tubular members 28 of each grid 30 are configured so that with each tubular member 28 so disposed, when the patient sinks into chambers 80 sufficiently to approach base 82 too closely, the patient's body begins to contact at least ,one such tubular member 28 or cause one or more of the chamber(s) 80 to do so, sufficiently to produce an increase in pressure (schematically indicated by the dashed arrows in FIG. 3) in such at least one contacted tubular member 28.

In a multi-zone embodiment shown in FIG. 7 for example, the penetration sensing means can include a first means for sensing the pressure in at least one of the individual inflatable chambers of a first one of the groups of chambers of the patient support device. Similarly, the penetration sensing means can include a second means for sensing the pressure in at least one of the individual inflatable chambers of a second one of the groups of chambers of the patient support device. Similarly, an individual penetration sensing means can be provided for each of the groups of chambers 80 of the patient support device. As schematically shown in FIG. 7, a separate tubular grid 30 can be provided for each discrete group of inflatable chambers 80 that is supplied with air by its own air supply conduit 24 of the patient support device.

Figure 5:
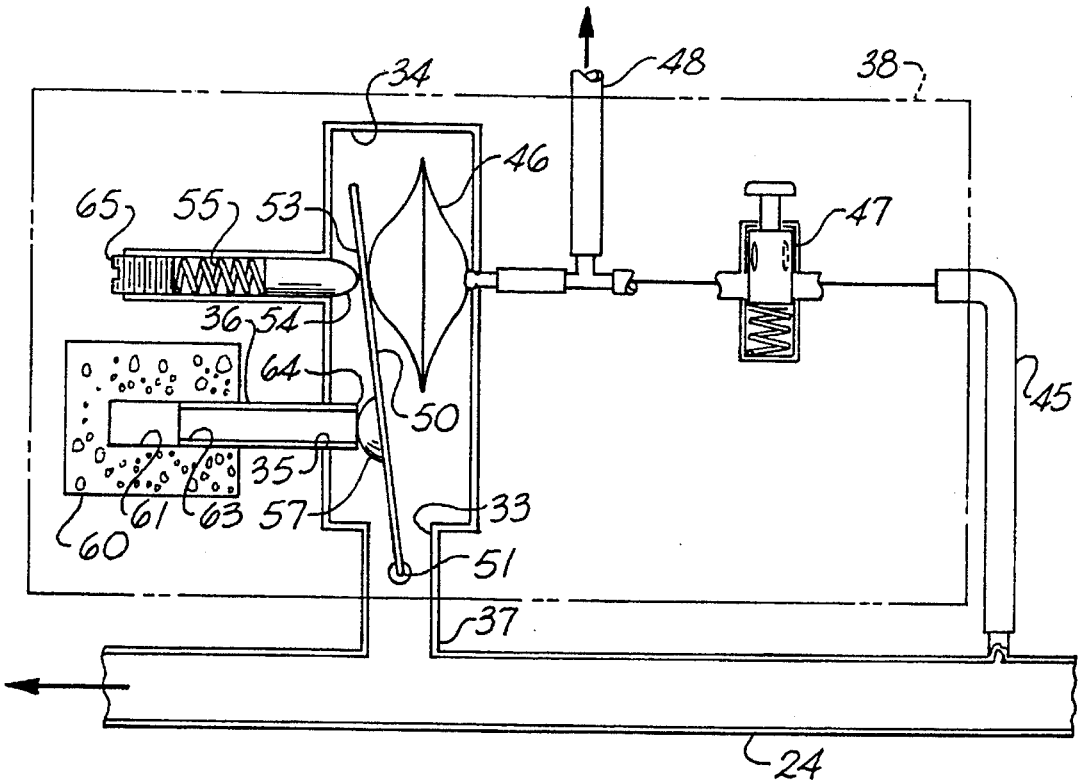
FIG. 5 schematically depicts preferred embodiments of components of a preferred embodiment of the present invention.
Figure 6:
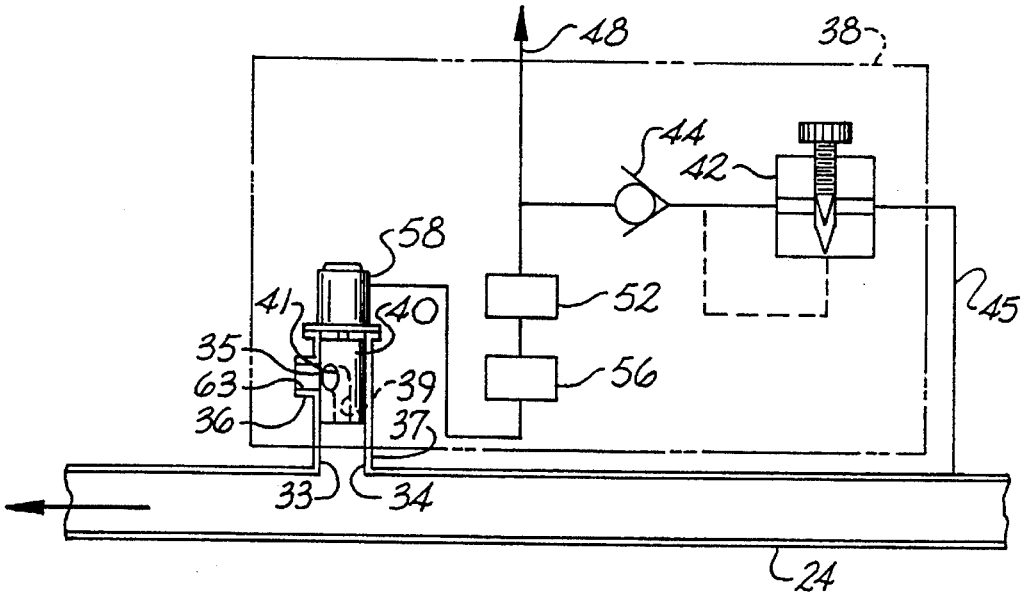
FIG. 6 schematically depicts preferred embodiments of alternative components of an alternative preferred embodiment of the present invention.

In further accordance with the present invention, a means can be provided for exhausting air from the air supply conduit. As embodied herein and schematically shown in FIGS. 5 and 6, the air exhausting means can include a plenum 34 having an inlet opening 33 and an outlet opening 35. The plenum's inlet opening 33 can be connected in communication with the air supply conduit 24 of the device. As schematically shown in FIGS. 5 and 7 for example, a connecting conduit 37 may be used to connect the inlet opening of the plenum to the air supply conduit 24 of the patient support device. As schematically shown in FIGS. 5 and 6, the air exhausting means also can include an outlet tube 36 disposed through the outlet opening 35 in the plenum 34 and having an open exhaust end 63.

In an embodiment having a plurality of penetration sensing means, one to serve each of a plurality of groups of inflatable chambers of the patient support device, a first means for exhausting air from the air supply conduit can be provided. As schematically shown in FIG. 7, a separate means for exhausting air from the air supply conduit can be provided for each of the groups of the inflatable chambers 80 of the patient support device 70. Each square designated 38 in FIG. 7 can be considered schematically to include an air exhausting means that can have a separate plenum 34 having an inlet opening 33 and an outlet opening 35, wherein the inlet opening can be connected in communication with a corresponding air supply conduit 24 of the device. In addition, each of the air exhausting means can include a separate outlet tube 36 disposed through the outlet opening 35 in the separate plenum 34.

In still further accordance with the present invention, a means can be provided for varying the flow of air exhausted from the air supply conduit by the air exhausting means. As embodied herein and shown schematically in FIGS. 6 and 8, the exhaust flow varying means can include a variable flow valve 40. As shown in greater detail in FIG. 6, variable flow valve 40 can have an inlet 39 connected in communication with the inlet opening 33 of the air exhausting means. Variable flow valve 40 has an outlet 41 connected in communication with the outlet opening 35 of plenum 34 and with open exhaust end 63 of outlet tube 36.

In an alternative embodiment, the exhaust flow varying means can include a flexible gasket which can be configured and disposed to variably engage with the entrance end of the outlet tube. As embodied herein and shown schematically in FIG. 5, a rigid member 50 can be pivotally mounted at one end 51. Rigid member 50 also can have an intermediate portion that carries a conventional flexible gasket 57 that is disposed to variably engage an entrance end 64 of outlet tube 36 in a sealing manner as rigid member 50 pivots about its one end 51. As flexible gasket 57 increasingly engages entrance end 64 of outlet tube 36, the rate of air flow that is permitted to exit the exhaust end 63 of outlet tube 36 decreases. Similarly, as flexible gasket 57 decreasingly engages entrance end 64 of outlet tube 36, an increased rate of air flow is permitted to exit the exhaust end 63 of outlet tube 36. As schematically shown in FIG. 5 for example, the exhaust end 63 of outlet tube 36 can be disposed in an opening 61 in a muffler 60 formed of a porous sheath of sound deadening material, which can be contained in a canister (not shown) having exit holes therethrough.

In an embodiment configured for a patient support device with at least two separately inflated groups of chambers, the exhaust flow varying means can include a first exhaust flow varying means for a first air exhausting means, a second exhaust flow varying means for a second air exhausting means, and similarly separate exhaust flow varying means for each separate air exhausting means. Each square designated 38 in FIG. 7 can be considered to schematically include a separate exhaust flow varying means for each separate air exhausting means. For example, as schematically shown in FIG. 5, the first exhaust flow varying means can include a first rigid member 50 that carries a first flexible gasket 57, which is configured and disposed to variably engage an entrance end 64 of a first outlet tube 36.

In yet further accordance with the present invention, a means can be provided for controlling the exhaust flow varying means in accordance with the signal generated by the penetration sensing means. In effect, the exhaust flow varying means is controlled in accordance with the degree of penetration being sensed by the penetration sensing means. As embodied herein and shown in FIG. 6, the controlling means can include a pressure transducer 52 and a controller 56. Pressure transducer 52 can be connected in fluid communication with the penetration sensing means by an air communication conduit 48 (also shown in FIGS. 1, 4, 6 and 7) and in electrical communication with controller 56 as schematically shown by the solid connecting line between transducer 52 and controller 56 in FIG. 6. Controller 56 desirably can be connected into communication with the exhaust flow varying means. As embodied herein and schematically shown in FIG. 6 for example, controller 56 can be electrically connected to a motor 58 (such as a stepping motor) which opens and closes variable flow valve 40 depending on the electrical signal generated by controller 56, which can be a conventional analog or digital controller and can be programmable.

In an alternative embodiment shown schematically in FIG. 5 for example, the controlling means can include a bellows 46 disposed inside plenum 34 with the interior of bellows 46 being connected in fluid communication with the penetration sensing means via an air communication conduit 48 (also shown in FIGS. 1, 4, 6 and 7). Rigid member 50 has a biasing portion 53 disposed against the exterior of bellows 46. In addition, the controlling means can include a means for biasing the biasing portion 53 of the rigid member 50 against the bellows 46. As embodied herein and shown schematically in FIG. 5, the biasing means can include a detent 54 biased by a spring 55 against the biasing portion 53 of rigid member 50. A threaded adjustment screw 65 permits the operator to adjust the biasing force exerted by spring 55 in order to accommodate different pressure levels in the chambers 80.

In an embodiment configured for a patient support device with at least two separately inflated groups of chambers, the controlling means can include a first controlling means for a first exhaust flow varying means, and a second controlling means for a second exhaust flow varying means. Similarly, separate controlling means can be provided for each separate exhaust flow varying means in embodiments having more than two separately inflated groups of chambers. Each square designated 38 in FIG. 7 can be considered to schematically include a separate controlling means for each separate exhaust flow varying means. However, a common control means can be provided to serve more than one separate exhaust flow varying means. For example, as schematically shown in FIG. 6, each separate controlling means can include a separate pressure transducer 52, and a common controller 59 (such as shown schematically in FIG. 7) can be electrically connected to receive signals from each separate transducer 52 and electrically connected to control each separate variable flow valve 40. In another embodiment, a common controller 59 can be electrically connected to receive signals from each separate individual controller 56, which is connected to a separate transducer 52 as schematically shown in FIG. 6 for example, and common controller 59 can be electrically connected to control each separate variable flow valve 40, either directly or via separate controller 56. In yet another embodiment schematically shown in FIG. 8, a common controller 59 receives electrical signals from each pressure switch 43 and is electrically connected and programmed to control blower 26 and/or motor 58 of each respective flow valve 40. Common controller 59 can be a conventional analog or digital controller and can be programmable. In another example which can be derived schematically from FIG. 7, each separate controlling means schematically represented by square 38 can include a separate bellows 46 and a separate detent 54 biased by a separate spring 55 against the biasing portion 53 of a separate rigid member 50. In this latter embodiment, there would not need to be any electrical connection between common controller 59 and the components schematically represented by each square 38.

In embodiments of the invention such as shown in FIGS. 5 and 6, a means can be provided for supplying air to the penetration sensing means via the air supply conduit of the device without returning air from the penetration sensing means to the air supply conduit of the device. As embodied herein and shown in FIG. 6 for example, the air supplying means can include an air flow branch 45 connected in communication with air supply conduit 24, a pressure regulator 42 connected in communication with branch 45, and a check valve 44 connected in communication with regulator 42 and air communication conduit 48.

Alternatively, as shown in FIG. 5 for example, the air supplying means can include an air flow branch 45 connected in communication with air supply conduit 24, a push-button valve 47 connected in communication with branch 45 and with air communication conduit 48. In embodiments using push-button valve 47 instead of pressure regulator 42 and check valve 44, before a patient is placed on the chambers 80 of the overlay, the bellows 46 is inflated with low pressure air via the push-button valve 47 (FIG. 5), and the air flow in the bellows 46 is then at a relative maximum pressure while the pressure inside the chambers 80 is at a relative minimum. Thus, the sensor air circuit composed of tubular members 28, 29 would be inflated before placing the patient on the overlay chambers 80 in order to avoid placing the patient on the overlay chambers when the pressure in the overlay sensor circuit 28, 29, 48 is minimal. In order to prevent inadvertent pressing of the button and depletion of the chambers 80 of the overlay when the patient is being supported on the chambers 80 of the overlay, a means to prevent pushing the button of the push button valve 47 should be provided. Any conventional means for preventing inadvertent activation of the push button can be employed.

As shown in FIG. 7, in an embodiment having a plurality of separate groups of chambers in the patient support device, a separate air supplying means can be provided for each separate penetration sensing means. Thus, a first air supplying means can be provided for a first penetration sensing means such as a first tubular grid 30. Similarly, a separate air supplying means can be provided for a second penetration sensing means and so on. Each square designated 38 in FIG. 7 can be considered to include a separate air supplying means for each separate penetration sensing means. For example, as schematically shown in FIG. 5, a first air supplying means can include a first push button valve 47 connected in fluid communication with a first air communication conduit 48 and a first bellows 46. Similarly, as schematically shown in FIG. 6, a second air supplying means can include a second check valve 44 and a second pressure regulator valve 42 connected in fluid communication with a second air communication conduit 48 and a second pressure transducer 52.

Upon being placed on the chambers 80 of the overlay (or mattress), a patient sinks into the chambers 80 forming the support surface of the patient support device. The pressure in the chambers 80 is adjusted, by adjusting the blower speed for example or by manual or automatic adjustment of the exhaust flow varying means, so that the patient is supported at an ideal penetration depth within the chambers 80. When, as schematically shown in FIG. 3, the patient sinks sufficiently so that the body of the patient and/or chambers 80 touch or otherwise apply sufficient pressure to at least one of the penetration sensing means, the penetration sensing means generates a signal. In the embodiment shown schematically in FIG. 6, this increased pressure on tubular members 28 of the sensor circuit generates a pressure signal that is applied to the pressure transducer 52, which in turn issues an electrical signal to the controller 56. In one embodiment, the controller 56 is preprogrammed to respond to this transducer signal indicative of increased pressure by controlling variable flow valve 40 so that the air flow through the valve 40 decreases. This decrease in air flow through valve 40 causes the pressure within the chambers 80 of the overlay to increase, and this lifts the patient until the chambers 80 are no longer applying pressure to the tubular members 28. Then the pressure inside tubular members 28 decreases. Whereupon, the transducer 52 senses a reduced pressure and signals this reduced pressure to controller 56, which is preprogrammed to respond to this reduced pressure by allowing more air to escape through the valve 40. The controller can be programmed to continue these adjustments until an equilibrium is achieved for each configuration of chambers and tubular members 28 and weight profile of the patient in whatever position the patient assumes on the overlay. The equilibrium allows ideal positioning of the patient (close to the bottom but with a safe distance above the mattress underneath). In this way, the system reacts to any change in positioning, and the pressure inside the chambers of the patient support device is automatically adjusted to suit the exact situation.

Similarly, when the patient sinks sufficiently so that the chambers 80 touch the tubular members 28 of the sensor in the embodiment shown schematically in FIG. 5, this increases the sensor circuit pressure and inflates the bellows 46 inside the exhaust plenum 34. The increased pressure inside bellows 46 allows bellows 46 to push rigid member 50 toward spring 55 and entrance end 64 of outlet tube 36 so that gasket 57 increasingly engages entrance end 64 and allows less air to enter outlet tube 36. Accordingly, the air flow through the muffler 60 then decreases and the pressure within the chambers 80 of the overlay increases, lifting the patient. Adjustments to screw 65 enable the operator to control when the pressure in tubular member 28 will trigger the reduced air flow into the outlet tube 36 that causes a pressure adjustment in the chambers 80. When the patient is lifted sufficiently, the pressure inside tubular members 28 decreases and with it the pressure inside bellows 46 decreases. The reduced pressure inside bellows allows spring 55 to push rigid member 50 away from entrance end 64 of outlet tube so that gasket 57 decreasingly engages entrance end 64 and allows more air to escape through the muffler 60. Eventually, an equilibrium is achieved automatically and maintains ideal positioning of the patient (close to the base but with a sufficient margin of distance between the patient and the base). In this way, the system reacts to any change in positioning, and the pressure inside the overlay automatically adjusts to suit the exact situation.

The present invention automatically customizes the pressure for any patient, provided the basic pressure losses from the air distribution channels of the overlay, the holes 83 in chambers 80, and through muffler 60 or variable flow valve 40, are sufficiently low to allow the lightest patient to touch the sensor tubes 28. The present invention also allows retrofitting overlays without any modification. In addition, the present invention eliminates the need for a pressure comfort knob, and permits use of low and high pressure alarms to monitor correct positioning of the patient. Since the air loss from the valve 40 or muffler 60 is adjustable, by exhausting excess air flow through the valve 40 or muffler 60, heat problems would be reduced whilst all vents on the overlay could be maintained. Moreover, the present invention eliminates the need to provide a blower with speed regulation.

However, as schematically shown in FIGS. 7 and 8 for example, the present invention can be configured to control a variable speed blower in addition to or instead of regulating the exhaust flow of air from the chambers 80 of the patient support device. Blower 26 can be electrically connected to controller 59 as shown by the dashed line in FIG. 7 and the solid line in FIG. 8. Controller can be programmed to change the speed of blower 26 depending on the signal received from the penetration sensing means.

What is claimed is:

1. An apparatus for automatically regulating the support pressure in at least one inflatable chamber forming at least part of the support surface of a patient support device supplied with inflating air via an air supply conduit, the inflatable chamber having a base disposed generally opposite the support surface of the chamber, the apparatus comprising:

a means for exhausting air from the air supply conduit;

a means for varying the flow of air exhausted from the air supply conduit by said air exhausting means; and a means for sensing when a portion of the patient is exceeding a predetermined degree of penetration into the support surface of the patient support device, said penetration sensing means being configured with a portion having an elongated shape for disposition parallel to and along the base of at least one inflatable chamber, said penetration sensing means being connected in communication with said exhaust flow varying means.

2. An apparatus as in claim 1, wherein said penetration sensing means includes:

at least one pressure switch, said pressure switch being configured and disposed at the base of at least one of the individual inflatable chambers of the patient support device so that upon more than a predetermined degree of penetration of the patient into the support surface, said pressure switch produces a signal.

3. An apparatus as in claim 2, further comprising:

a means for controlling said exhaust flow varying means in accordance with the penetration sensed by said penetration sensing means, said controlling means being connected in communication with said penetration sensing means.

4. An apparatus as in claim 3, wherein said controlling means includes a programmable controller electrically connected in communication with said pressure sensitive switch.

5. An apparatus as in claim 3, further comprising:

a variable speed blower configured and disposed to supply air to the air supply conduit, wherein said controlling means is electrically connected to control the speed of said blower.

6. An apparatus as in claim 1, wherein said penetration sensing means includes:

at least one tubular member, said tubular member being configured to be disposed at the base of at least one of the individual inflatable chambers of the patient support device so that above a predetermined threshold penetration of the patient into at least one of the chambers, a change in pressure is applied to at least one tubular member.

7. An apparatus as in claim 6, further comprising:

a means for supplying said penetration sensing means with air from the air supply conduit of the device without returning air from said penetration sensing means to the air supply conduit of the device, wherein said air supplying means includes a pressure regulator and a check valve.

8. An apparatus as in claim 1, wherein said exhaust flow varying means includes a variable flow valve having an inlet connected in communication with said air exhausting means.

9. An apparatus as in claim 1, further comprising:

a means for controlling said exhaust flow varying means in accordance with the degree of penetration sensed by said penetration sensing means.

10. An apparatus as in claim 9, wherein said means for exhausting air from the air supply conduit includes:

a plenum having an inlet opening and an outlet opening, said inlet opening being connected in communication with the air supply conduit of the device; and an outlet tube disposed in communication with said outlet opening in said plenum and having an entrance end and an exhaust end disposed generally opposite to said entrance end.

11. An apparatus as in claim 10, wherein said exhaust flow varying means includes a rigid member pivotally mounted at one end and a flexible gasket carried by said rigid member and configured and disposed to variably engage said entrance end of said outlet tube; and wherein said controlling means includes a bellows disposed inside said plenum with the interior of said bellows being connected in communication with said penetration sensing means and a portion of said rigid member being disposed against the exterior of said bellows, and a means for biasing a portion of said rigid member against said bellows.

12. An apparatus as in claim 9, wherein said controlling means includes:

a pressure transducer and a controller, said pressure transducer being connected in fluid communication with said penetration sensing means and to said controller, said controller being connected in communication with said exhaust flow varying means.

13. An apparatus as in claim 12, further comprising:

a variable speed blower configured and disposed to supply air to the air supply conduit, wherein said controller is electrically connected to control the speed of said blower.

14. An apparatus for automatically regulating the support pressure in at least one inflatable chamber forming at least part of the support surface of a patient support device supplied with inflating air via an air supply conduit, the inflatable chamber having a base disposed generally opposite the support surface of the chamber, the apparatus comprising:

a means for exhausting air from the air supply conduit;

a means for varying the flow of air exhausted from the air supply conduit by said air exhausting;

a means for sensing when a portion of the patient is exceeding a predetermined degree of penetration into the support surface of the patient support device, said penetration sensing means being connected in communication with said exhaust flow varying means, wherein said penetration sensing means includes at least one tubular member, said tubular member being configured to be disposed at the base of at least one of the individual inflatable chambers of the patient support device so that above a predetermined threshold penetration of the patient into at least one of the chambers, a change in pressure is applied to at least one tubular member; and a plurality of tubular members configured to form with said at least one tubular member, an interconnected tubular grid that is configured to be disposed with each said tubular member at the base of one of the individual inflatable chambers of the patient support device so that an increase in pressure on the inflatable chamber produces an increase in pressure on at least one of said tubular members.

15. An apparatus for automatically regulating the support pressure in at least one inflatable chamber forming at least part of the support surface of a patient support device supplied with inflating air via an air supply conduit, the inflatable chamber having a base disposed generally opposite the support surface of the chamber, the apparatus comprising:

a means for exhausting air from the air supply conduit;

a means for varying the flow of air exhausted from the air supply conduit by said air exhausting means;

a means for sensing when a portion of the patient is exceeding a predetermined degree of penetration into the support surface of the patient support device, said penetration sensing means being connected in communication with said exhaust flow varying means, wherein said penetration sensing means includes at least one tubular member, said tubular member being configured to be disposed at the base of at least one of the individual inflatable chambers of the patient support device so that above a predetermined threshold penetration of the patient into at least one of the chambers, a change in pressure is applied to at least one tubular member; and a means for supplying said penetration sensing means with air from the air supply conduit of the device without returning air from said penetration sensing means to the air supply conduit of the device, wherein said air supplying means includes a push button valve.

16. An apparatus for automatically regulating the support pressure in each of a plurality of individual inflatable chambers forming the support surface of a patient support device supplied with inflating air via an air supply conduit, the apparatus comprising:

at least one tubular member configured to be disposed at the base of one of the individual inflatable chambers of the patient support device so that said tubular member is subjected to a change in pressure when the patient is being supported with more than a predetermined degree of penetration of the patient into the support surface of the patient support device;

a plenum having an inlet opening and an outlet opening, said inlet opening being connected in communication with the air supply conduit of the device;

a bellows disposed inside said plenum with the interior of said bellows being connected in communication with said at least one of said tubular members;

a rigid member having one end pivotally mounted and having a portion disposed against said bellows;

a means for biasing said portion of said rigid member against said bellows;

an outlet tube disposed through said outlet opening in said plenum and having an entrance end;

a flexible gasket carried by said rigid member and configured and disposed to variably engage said entrance end of said outlet tube; and a means for supplying said penetration sensing means with air from the air supply conduit of the device without returning air from said penetration sensing means to the air supply conduit of the device.

17. An apparatus as in claim 16, further comprising:

a second means for sensing when the patient is being supported with more than a predetermined degree of penetration of the patient into the support surface of the patient support device, said second penetration sensing means being disposed near the base of at least one inflatable chamber of a second one of the groups of chambers of the patient support device;

a second means for exhausting air from the air supply conduit;

a second means for varying the flow of air exhausted from the air supply conduit via said second air exhausting means; and a second means for supplying said second penetration sensing means with air from the air supply conduit of the device without returning air from said second penetration sensing means to the air supply conduit of the device.

* * * * *